United States Patent [19]

Cho

[11] 4,346,502

[45] Aug. 31, 1982

[54] TENTER ARM SWINGING APPARATUS

[76] Inventor: Hideyuki Cho, c/o Toyo Machinery Co. Ltd., No. 29-6, Zuiko-dori, Higashiyodogawa-ku, Osaka-shi, Japan

[21] Appl. No.: 190,405

[22] Filed: Sep. 24, 1980

[30] Foreign Application Priority Data

Oct. 1, 1979 [JP] Japan ..... 54-136389[U]

[51] Int. Cl.[3] ..... D06C 3/02

[52] U.S. Cl. ..... 26/76

[58] Field of Search ..... 26/76, 86

[56] References Cited

U.S. PATENT DOCUMENTS 3,150,431 9/1964 Fazis ..... 26/76

3,216,081 11/1965 Leimer et al. ..... 26/76

FOREIGN PATENT DOCUMENTS 229315 4/1925 United Kingdom ..... 26/76

493411 10/1938 United Kingdom ..... 26/76

*Primary Examiner*—Robert Mackey

*Attorney, Agent, or Firm*—Larson and Taylor

[57] ABSTRACT

The present application discloses a tenter arm swinging apparatus in which the swing of a tenter arm is performed by rotating a nut threadedly connected to a fixed screw shaft, and arm swinging means is housed in a case housing said nut.

According to the present invention, the whole apparatus may be constructed in a very compact structure and installed readily and conveniently, regardless of the spatial conditions outside the apparatus.

3 Claims, 4 Drawing Figures

TENTER ARM SWINGING APPARATUS

BACKGROUND OF THE INVENTION

A convential tenter arm swinging apparatus is generally constructed in such a way that a nut secured to a tenter arm is threadedly connected to a screw shaft rotatably journalled in the vicinity of the front of the arm, and the screw shaft is adapted to be rotated by swinging means disposed outside the apparatus and comprising a screw shaft rotating pulley, a transmission belt and a reversible rotatable motor, and the rotation of the screw shaft causes the nut to be transversely moved to swing the arm.

According to such conventional apparatus, since the swinging means is disposed outside the apparatus, it is inevitable that the whole apparatus becomes quite large, so that a broad space for installation is required.

There is another installation problem in that the component elements should be arranged to take spatial conditions ouside of the apparatus into account; for example, the screw shaft bearing portions and the motor should be mounted to the frame, respectively, to take the transmission belt travel distance into account.

SUMMARY OF THE INVENTION

The present invention relates to improvements in a tenter arm swinging apparatus, in which side-movement of a travelling fabric is automatically detected and corrected, so that the fabric may be properly tentered while travelling in a straight line.

It is a main object of the present invention to provide a tenter arm swinging apparatus in which the swing of a tenter arm is performed by rotating a nut threadedly connected to a fixed screw shaft, and an arm swinging means is housed in a case housing the nut, so that the entire apparatus may be constructed in a very compact structure, which may be installed in a limited space in a highly convenient manner.

It is another object of the present invention to provide a tenter arm swinging apparatus in which the incorporation of the arm swinging means into the nut housing case permits the nut rotating members, i.e. a motor, a transmission belt, a pulley, etc., to be installed readily and conveniently, regardless of the spatial conditions outside the apparatus.

BRIEF DESCRIPTION OF THE DRAWINGS

The present invention will be further described, by way of example, with reference to the accompanying drawings, in which.

DETAILED DESCRIPTION OF THE PREFERRED EMBODIMENT

Figure 1:
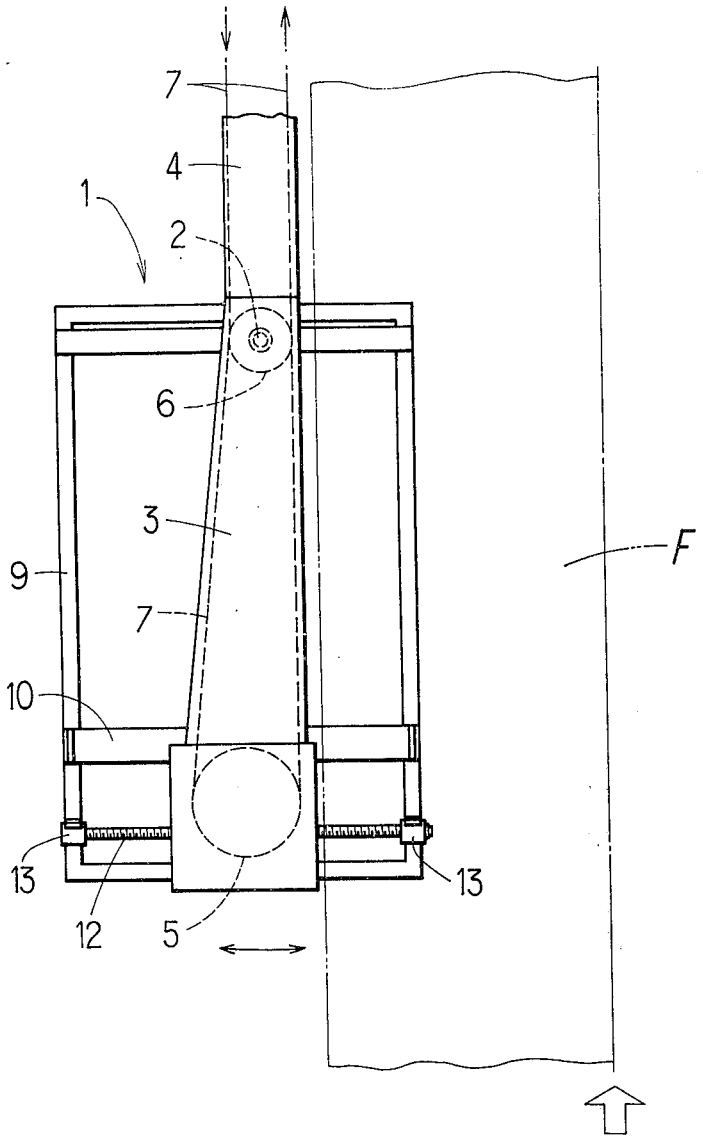
FIG. 1 is a plan view of a portion of a tenter equipped with a tenter arm swinging apparatus in accordance with the present invention.
Figure 2:
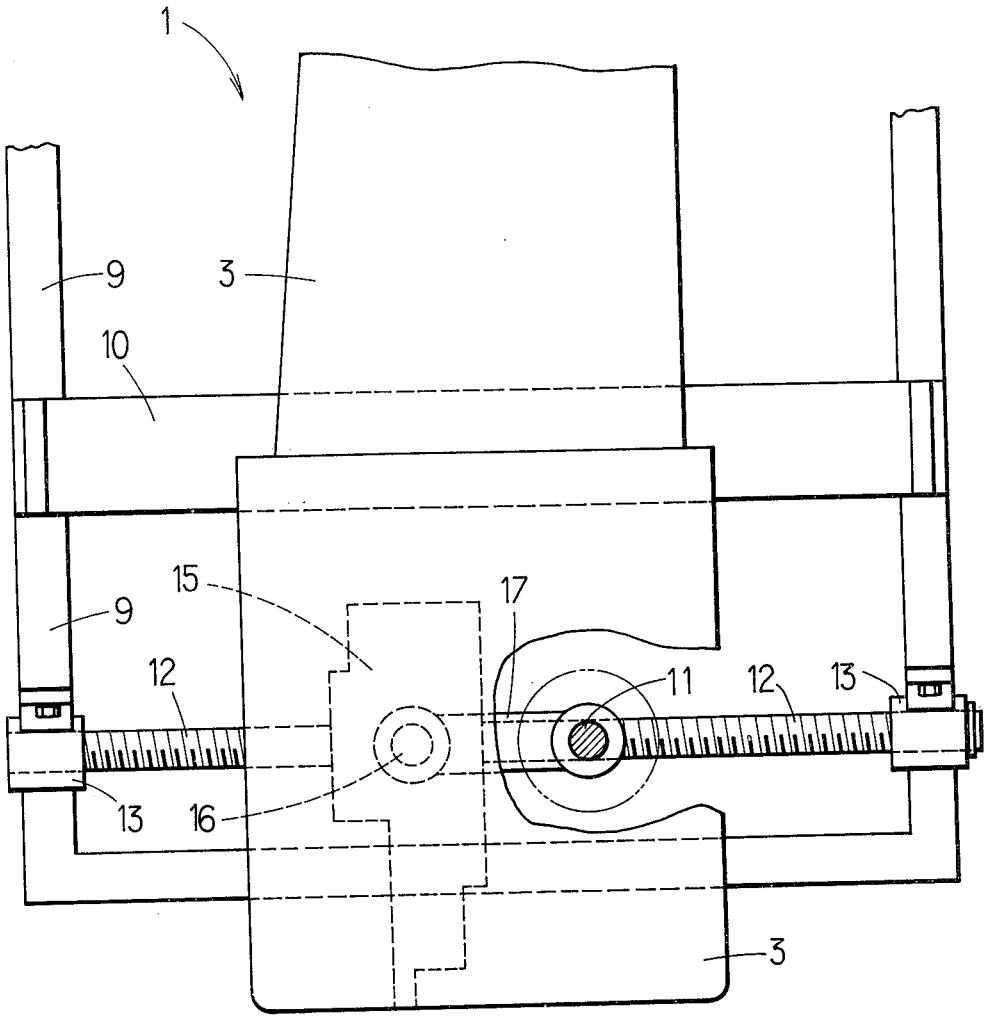
FIG. 2 is an enlarged plan view, of a portion of FIG. 1, with portions broken away, showing main portions of the apparatus of the present invention.
Figure 3:
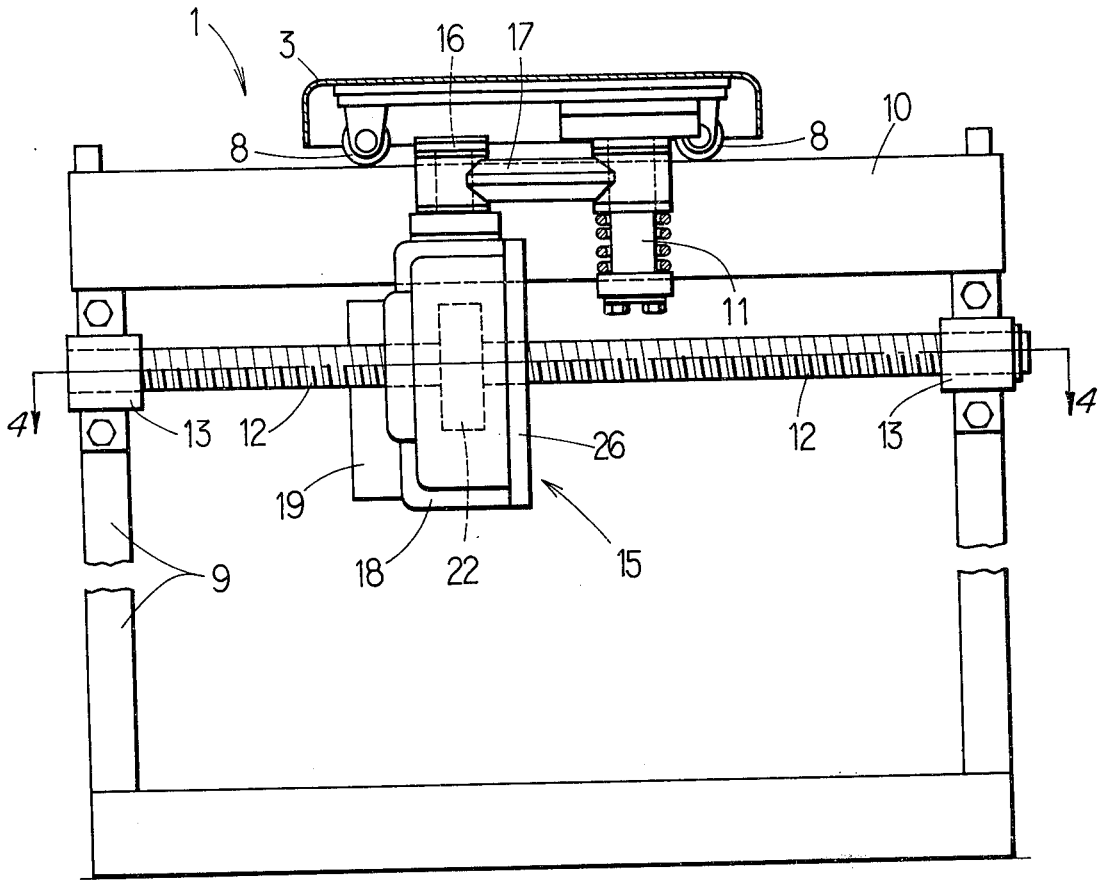
FIG. 3 is a front elevational view, with portions broken away, of main portions of the apparatus of the present invention.
Figure 4:
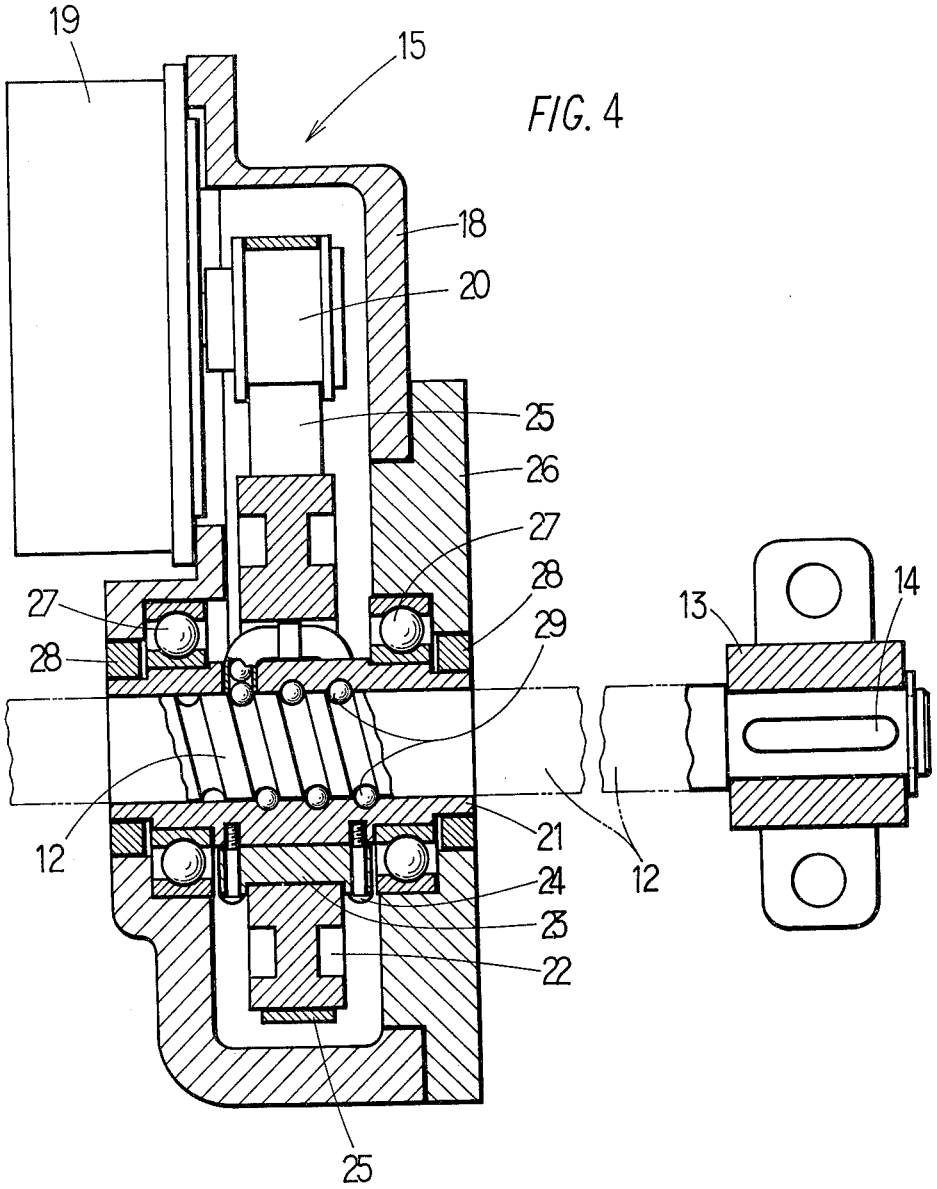
FIG. 4 is an enlarged partial section view, taken along 4—4 of FIG. 3.

FIGS. 1 to 4 illustrate an embodiment of a tenter arm swinging apparatus in accordance with the present invention.

In a tenter, tentering means 1 are disposed at both sides with respect to a travelling fabric F (only one tentering means at one side shown). Each of the tentering means 1 has an arm 3 of which the front portion is adapted to be transversely swung about a rotary shaft 2 at the rear end thereof as a pivot. The arm 3 is connected at the pivoted side thereof to a cover 4. Sprockets 5 and 6 are supported, at the shafts thereof, by the arm 3 and the cover 4, respectively. Wound on these sprockets 5 and 6 is a chain 7 having suitable fabric selvedge holding means such as holding pins (not shown). The chain 7 is adapted to convey and tenter the fabric F in a predetermined direction.

Rotary rollers 8 disposed under the front portion of the arm 3 are supported by the upper surface of a wide support frame 10 transversely disposed above a frame 9. A shaft 11 is vertically disposed under the arm 3.

A screw shaft 12 is disposed at the frame 9 in the vicinity of the front end of the arm 3. Both ends of this screw shaft 12 are fixed to the frame 9 by metal fittings 13 secured thereto, with keys 14 for preventing rotation of the screw shaft 12.

Swinging means 15 for swinging the arm 3 is disposed at the screw shaft 12. A shaft 16 vertically projected from the swinging means 15 is connected to the shaft 11 vertically disposed under the arm 3, through a link 17.

Disposed in a case 18 of the swinging means 15 is a reversible rotatable motor 19 adapted to be rotated forwardly or in reverse by a signal from a sensor (not shown) which has detected side-movement of the travelling fabric F. A drive pulley 20 is mounted to the drive shaft of the motor 19.

A nut 21 is threadedly connected to the screw shaft 12, and a follower pulley 22 is secured to the outer periphery of this nut 21 through a key 23 and set screws 24. A transmission belt 25 is set up on the pulleys 20 and 22. The transmission belt 25 and the pulleys 20 and 22 constitute transmission means, which is housed in the case 18.

The nut 21 is journalled by the case 18 and the cover 26 through bearings 27. Seals 28 are disposed between the nut 21 and the case 18, and between the nut 21 and the cover 26, respectively.

A plurality of balls 29 having low frictional resistance are fittingly disposed in a spiral groove formed between the screw shaft 12 and the nut 21.

For coupling means to connect the arm 3 to the swinging means 15, there may be used other suitable universal joints which do not prevent the movements of the arm 3 and the swinging means 15.

The description hereinafter will discuss the operation of the tenter arm swinging apparatus in accordance with the present invention.

When the reversibly rotatable motor 19 is rotated forwardly or in reverse by a signal from the sensor, the nut 21 threadedly connected to the screw shaft 12 is rotated forwardly or in reverse through the drive pulley 20, the transmission belt 25 and the follower pulley 22. Since the screw shaft 12 is secured, at the both ends thereof, to the metal fitting 13 and is therefore not rotated, the rotation of the nut 21 causes the entire swinging means 15 to be moved along the shaft 12 in the left or right direction. With the movement of the swinging means 15, the arm 3 is rotated in the left or right direction through the link 17. Therefore, the fabric selvedge holding means disposed at the chain 7 are operative to pull the selvedge of fabric F in the left or right direction, so that the fabric is laterally guided to the normal position, whereby a predetermined tentering may be performed.

As thus discussed hereinbefore, according to the tenter arm swinging apparatus of the present invention, the swing of the tenter arm is performed by rotating the nut threadedly connected to the fixed screw shaft and the arm swinging means is housed in the case incorporating the nut, so that the entire apparatus may be constructed in a very compact structure. This presents advantages such that the apparatus of the present invention may be installed in a limited space, and such that the nut rotating members, i.e. the motor, the transmission belt, the pulley, etc. may be installed readily and conveniently, regardless of the spatial conditions outside the apparatus.

Although a particular embodiment of the present invention has been described, it is not intended that the present invention be limited to the particular embodiment illustrated therein, since such embodiment has been described only by way of example. Variations and modifications of the present invention may be made by those skilled in the art, and such variations and modifications are intended to be included within the scope of the following claims.

I claim:

1. A tenter arm swinging apparatus, comprising:

a frame, an arm having means for engaging the edge of a fabric, said arm being mounted on the frame for pivotal movement about a pivot axis which extends perpendicularly to the plane of the fabric, a threaded shaft fixedly mounted on the frame so as to be prevented from rotating relative thereto, a case, a nut rotatably disposed in the case and threadedly engaging the threaded shaft, a reversible motor responsive to lateral deviation of the fabric edge also mounted in said case, and a transmission means also mounted in the case for conveying shaft rotation of the motor to rotary motion of the nut, thereby causing travelling movement of the nut and case along the threaded shaft, and coupling means connecting the case to the arm for causing pivotal movement of the arm about the said pivot axis in response to said travelling movement of the nut along the shaft to thereby maintain the fabric edge in a predetermined position.

2. A tenter arm swinging apparatus according to claim 1 wherein said transmission means comprises a drive pulley attached to the output shaft of the reversible motor, a follower pulley attached to the outer periphery of said nut, and a transmission belt interconnecting said pulleys.

3. A tenter arm swinging apparatus according to claim 1, said coupling means comprising a first shaft projecting from said case in a direction parallel to said pivot axis, a second shaft parallel to the first shaft and connected to said arm, and a cross link interconnecting the last two said shafts.

* * * * *